US012799941B2

(12) United States Patent
Dick et al.

(10) Patent No.: US 12,799,941 B2
(45) Date of Patent: Nov. 17, 2026

(54) AUTOMOTIVE ELECTRONIC FLUID PUMP

(71) Applicant: PIERBURG PUMP TECHNOLOGY GMBH, Neuss (DE)

(72) Inventors: Georg Dick, Neuss (DE); Jakob Ruszczyk, Neuss (DE); Monika Raja Thulasimani, Duesseldorf (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 0 days.

(21) Appl. No.: 18/866,077

(22) PCT Filed: May 31, 2022

(86) PCT No.: PCT/EP2022/064760
§ 371 (c)(1),
(2) Date: Nov. 15, 2024

(87) PCT Pub. No.: WO2023/232230
PCT Pub. Date: Dec. 7, 2023

(65) Prior Publication Data

US 2025/0357818 A1 Nov. 20, 2025

(51) Int. Cl.
*F04D 13/06* (2006.01)

(52) U.S. Cl.
CPC ..... *F04D 13/06* (2013.01); *F04D 13/0606* (2013.01); *F04D 13/0626* (2013.01);
(Continued)

(58) Field of Classification Search
CPC ..... F04D 13/0606; F04D 13/0626; F04D 13/0653; F04C 2240/30; F04C 2240/40
See application file for complete search history.

(56) References Cited

U.S. PATENT DOCUMENTS 2,805,626 A * 9/1957 Pezzillo ..... F04D 13/0633 417/357
4,773,822 A * 9/1988 Jensen ..... F04D 29/20 415/36

(Continued)

FOREIGN PATENT DOCUMENTS

JP 2000-14110 A 1/2000
JP 2006-115612 A 4/2006

(Continued)

*Primary Examiner* — Christopher S Bobish
(74) *Attorney, Agent, or Firm* — Norman B. Thot

(57) ABSTRACT

An automotive electronic fluid pump includes an electric pump motor. The electric pump motor includes a motor stator having stator coils, a rotor having a motor rotor, a pump rotor and a rotor shaft, a motor electronics arranged within a dry electronics chamber, a separation tube which fluidically separates a wet motor rotor chamber from a dry motor stator chamber, and a motor housing frame. The motor rotor is driven by the motor stator. The motor electronics has power semiconductors which energize the stator coils. The separation tube has a support section. The motor housing frame has a support collar, a frame bottom wall, and a frame side wall. The support collar directly supports the support section. The frame bottom wall defines a transversal separation wall which fluidically separates the wet motor rotor chamber from the dry electronics chamber. The frame side wall supports the electromagnetic motor stator.

9 Claims, 2 Drawing Sheets

(52) U.S. Cl.
CPC ..... *F04D 13/0653* (2013.01); *F04C 2240/30* (2013.01); *F04C 2240/40* (2013.01)

(56) References Cited

U.S. PATENT DOCUMENTS 5,336,064 A * 8/1994 Lamers ..... F04D 13/083 417/423.3
5,385,444 A * 1/1995 Kobayashi ..... F04D 29/2211 415/203
5,964,582 A * 10/1999 Kobayashi ..... F04D 29/0465 417/423.12
6,091,174 A * 7/2000 Genster ..... F04D 13/0606 310/58
8,083,500 B1 * 12/2011 Lebkuchner ..... H02K 5/128 417/423.15
8,597,000 B2 * 12/2013 Chien ..... F04D 29/0465 417/423.12
8,985,969 B2 * 3/2015 Hoshi ..... F04D 13/02 417/423.15
9,169,842 B2 * 10/2015 Chien ..... H02K 5/18
9,318,931 B2 * 4/2016 Kim ..... F04D 13/06
2005/0042119 A1 * 2/2005 Chien ..... F04D 13/0633 417/423.14
2005/0099773 A1 * 5/2005 Bernarding ..... F04D 29/588 257/714
2006/0034716 A1 * 2/2006 Marioni ..... F04D 13/06 417/423.12
2010/0272592 A1 * 10/2010 Chien ..... F04D 29/047 417/423.7
2013/0259720 A1 * 10/2013 Mills ..... H02K 5/203 417/410.1
2016/0007823 A1 * 1/2016 Hangmann ..... A47L 15/4285 415/206
2025/0129786 A1 * 4/2025 Dick ..... F04D 13/0633
2025/0137459 A1 * 5/2025 Marfing ..... F04D 29/669

FOREIGN PATENT DOCUMENTS

JP 2016-77097 A 5/2016
WO WO 2012/024778 A1 3/2012
WO WO-2013117628 A1 * 8/2013 ..... H02K 7/14
WO WO 2017/140334 A1 8/2017
WO WO-2021185131 A1 * 9/2021 ..... F04D 13/0606
WO WO-2021185653 A1 * 9/2021 ..... F04D 13/0633

* cited by examiner

AUTOMOTIVE ELECTRONIC FLUID PUMP

CROSS REFERENCE TO PRIOR APPLICATIONS

This application is a U.S. National Phase application under 35 U.S.C. § 371 of International Application No. PCT/EP2022/064760, filed on May 31, 2022. The International Application was published in English on Dec. 7, 2023 as WO 2023/232230 A1 under PCT Article 21(2).

FIELD

The present invention relates to an automotive electronic fluid pump with an electronically commutated pump motor which drives a pump rotor which is provided in a wet motor rotor chamber which is separated from a dry motor stator chamber by a substantially cylindrical separation tube. This pump concept avoids any dynamic sealings between the wet part and the dry part of the fluid pump.

BACKGROUND

An important issue of this pump concept is the exact coaxiality of the motor stator, the separation tube, and the motor rotor. A high reproduction quality of the coaxiality allows a small airgap to be defined between the motor stator and the motor rotor which in turn provides for a high electromagnetic efficiency of the motor. Another important issue of any electrical automotive device is the electromagnetic compatibility (EMC) of the device.

A metal motor frame generally provides for a high reproduction quality. WO 2017/140334 A1 descries a typical motor concept wherein a deep-drawn metal sheet body defines the separation tube, a rotor slide bearing ring, and a transversal separation wall for fluidically separating the wet motor rotor chamber from the dry electronics chamber. The pump housing is completely made of plastic so that no electromagnetic shielding of the motor stator is provided. The electromagnetic shielding could be provided by a metal pump housing which would, however, result in a relatively heavy and expensive fluid pump, features which are generally unacceptable for automotive devices and applications.

SUMMARY

An aspect of the present invention is to provide a competitive automotive electronic fluid pump with good electromagnetic efficiency and electromagnetic compatibility.

In an embodiment, the present invention provides an automotive electronic fluid pump which includes an electric pump motor. The electric pump motor comprises an electromagnetic motor stator comprising stator coils, a rotor comprising a motor rotor, a pump rotor and a rotor shaft, a motor electronics which is arranged within a dry electronics chamber, a separation tube which fluidically separates a wet motor rotor chamber from a dry motor stator chamber, and a motor housing frame which is arranged to be pot-like. The motor rotor is configured to be electromagnetically driven by the electromagnetic motor stator. The motor electronics comprises a commutation electronics and power semiconductors. The power semiconductors are configured to energize the stator coils. The separation tube comprises a support section. The motor housing frame comprises a support collar, a frame bottom wall, and a frame side wall which is arranged to be substantially cylindrical. The support collar is configured to directly support the support section of the separation tube. The frame bottom wall defines a substantially transversal separation wall which fluidically separates the wet motor rotor chamber from the dry electronics chamber. The frame side wall supports a radial outside of the electromagnetic motor stator. The motor housing frame is made from a deep-drawn metal sheet body. The support collar of the motor housing frame is made via a reverse-drawing of the deep-drawn metal sheet body.

BRIEF DESCRIPTION OF THE DRAWINGS

The present invention is described in greater detail below on the basis of embodiments and of the drawings in which.

DETAILED DESCRIPTION

Figure 1:
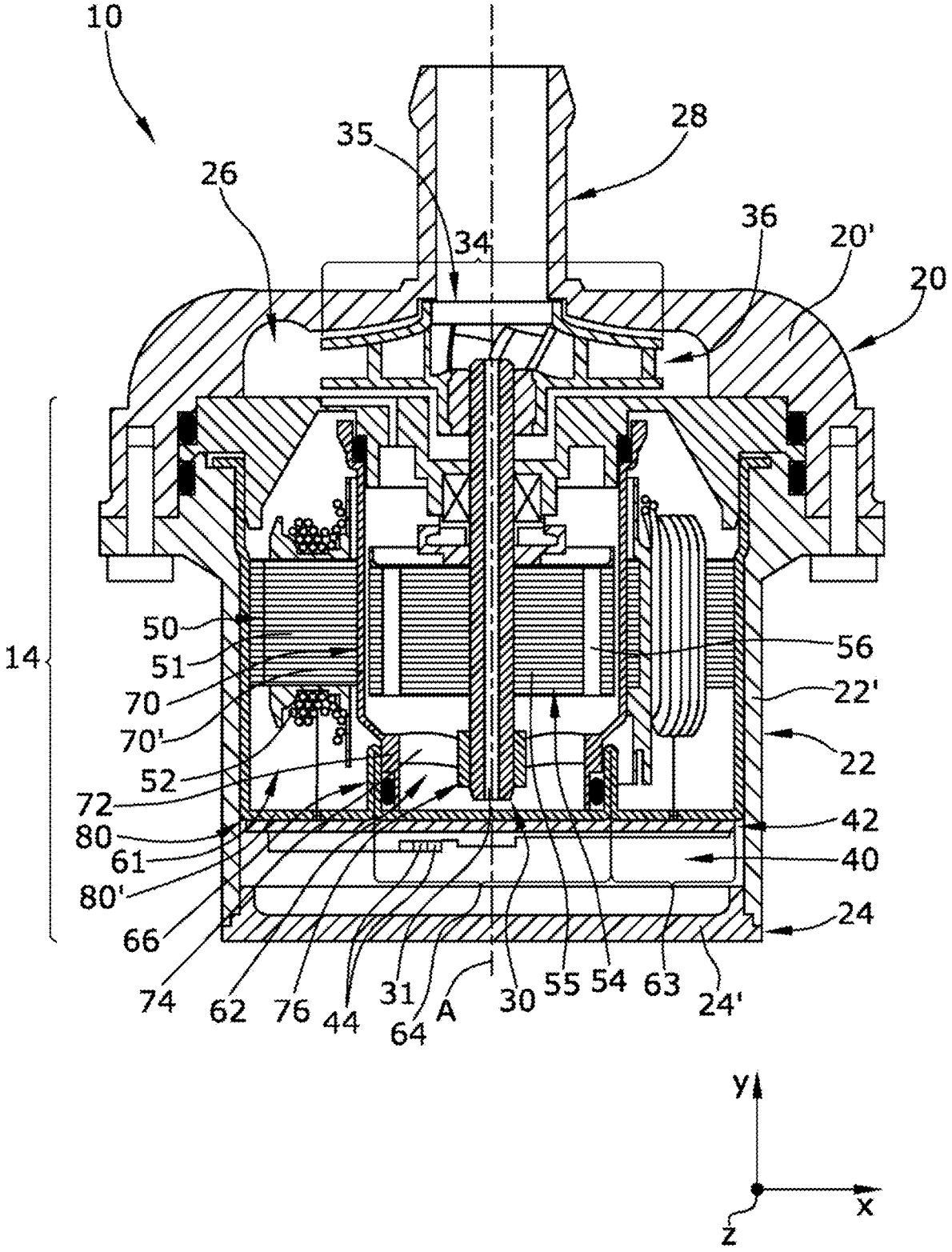
FIG. 1 shows schematically a longitudinal section of an automotive electronic fluid pump with a motor housing frame and a separation tube supported by the motor housing frame.

The automotive electronic fluid pump according to the present invention is provided with an electric pump motor comprising an electronic motor stator with several stator coils. The rotor comprises a motor rotor, a pump rotor, and a rotor shaft which mechanically and co-rotatably connects the motor rotor and the pump rotor. The motor rotor can, for example, be permanently magnetized and can, for example, be electromagnetically driven by the motor stator surrounding the central motor rotor. The pump rotor can be a positive displacement pump rotor or can, for example, be a flow pump rotor.

The motor electronics comprises a commutation electronics and several power semiconductors for electrically energizing the stator coils. The motor electronics is arranged within a dry electronics chamber which is axially adjacent to a wet motor rotor chamber. A non-ferrimagnetic separation tube fluidically separates the wet motor rotor chamber from the dry motor stator chamber and is provided in the cylindrical airgap between the motor rotor and the rotor stator. A substantially transversal separation wall fluidically separates the wet motor rotor chamber from the dry electronics chamber.

The present invention provides a pot-like motor housing frame which defines a bottom wall which lies substantially in a transversal plane and a cylindrical side wall which is substantially cylindrical in shape. The housing frame bottom wall defines the separation wall between the wet motor rotor chamber and the dry electronics chamber. The motor housing frame side wall portion supports the radial outside of the motor stator.

The motor housing frame is made of a deep-drawn metal sheet body which also defines a cylindrical support collar axially proximally protruding from the frame bottom wall into the motor rotor chamber which is made via a reverse-drawing. No additional machining is necessary to provide a sufficiently precise cylindrical support collar. The cylindrical support collar directly supports a cylindrical support section of the separation tube. The separation tube can be made of any suitable non-ferromagnetic material, for example, of plastic.

The motor housing frame can, for example, be made of a ferromagnetic metal material to provide a good electromagnetic shielding of the motor stator resulting in a good electromagnetic compatibility EMC of the fluid pump. The motor housing frame can, for example, be electrically grounded. Since the metal motor housing frame also defines the transversal separation wall between the wet motor rotor chamber and the dry electronics chamber, the transversal separation wall has a relatively high thermal conductivity so that the heat generated by the motor electronics can efficiently be conducted via the transversal separation wall to the pumping fluid. The power semiconductors of the motor electronics can, for example, be thermally coupled to the motor housing frame without any airgap in between.

The pumping fluid generally can be a gas or a liquid. The fluid pump can therefore be a liquid pump, for example, a coolant liquid pump of an automotive coolant and/or a heating circuit.

The metal sheet motor housing frame is sufficiently solid and stiff to precisely support and coaxially position the motor stator and the separation tube. The motor housing frame also electromagnetically shields the motor stator so that a good electromagnetic compatibility EMC is provided. The separation tube can, for example, be made of a lightweight and non-ferromagnetic material, for example, of a very cost-effective plastic material.

The support collar of the motor housing frame can, for example, support the radial outside surface of the support section of the separation tube. The support collar can, for example, lie approximately in the cylinder plane which is defined by the cylindrical airgap between the motor rotor and the motor stator. This results in a relatively large motor stator chamber which is not radially inwardly constricted in the section defined by the support collar. The separation tube support section can, for example, have a reduced radius compared to an air gap section of the separation tube.

The plastic separation tube body can, for example, also define a rotor shaft bearing support for rotatably supporting the rotor shaft. The rotor shaft bearing can, for example, be of the slide-bearing-type, and the plastic separation tube body can, for example, directly support or even directly define the outside bearing ring of the slide bearing.

The complete proximal transversal wall of the electronics chamber can, for example, be defined by the transversal bottom wall of the pot-like motor housing frame. The proximal transversal wall of the electronics chamber is the wall which separates the electronics chamber from the motor rotor chamber as well as from the motor stator chamber. Since the complete proximal transversal wall of the electronics chamber is defined by the transversal bottom wall of the motor housing frame, no additional wall for separating the electronics chamber from the motor stator chamber is required.

A separate and additional plastic motor housing can, for example, house and surround the motor housing frame. The plastic motor housing completely radially surrounds the motor housing frame so that the motor housing provides a mechanical protection of the motor housing frame. The motor stator is therefore radially surrounded by an inner wall which is defined by the motor housing frame and an adjacent outer wall which is defined by the plastic motor housing. The plastic motor housing can, for example, define the circumferential side wall of the electronics chamber.

An embodiment of the present invention is explained below with reference to the drawings.

FIG. 1 shows an automotive electronic fluid pump 10 which is, in the present embodiment, a liquid pump for pumping a coolant liquid in an automotive coolant circuit. The automotive electronic fluid pump 10 is provided with a brushless electric pump motor 14 which is commutated and energized by a motor electronics 42 comprising a commutation electronics and several power semiconductors 44 for energizing several stator coils 52 of an outside dry motor stator 50.

The fluid pump 10 is designed to be dynamic-sealing-free and comprises a wet motor rotor chamber 62 comprising a wet motor rotor 54 and a ring-like dry motor stator chamber 61 with a dry motor stator 50, both chambers 61, 62 being fluidically separated from each other by a substantially cylindrical plastic separation tube 70.

The wet motor rotor 54 is permanently magnetized and comprises a plurality of identical transversal ferromagnetic rotor sheets 55 and several permanently magnetized rotor pole magnets 56 defining several magnetic rotor poles. The wet motor rotor 54 rotates around a longitudinal pump axis A. The rotor of the fluid pump 10 comprises the wet motor rotor 54, a rotor shaft 30, and a pump rotor 34. The pump rotor 34 is, in the shown embodiment, an impeller wheel with an axial pump rotor inlet opening 35 and a circumferential radial pump rotor outlet opening 36 so that the present fluid pump 10 is a flow pump. The rotor shaft 30 is provided with an axial coolant channel bore 31 and mechanically co-rotatably connects the wet motor rotor 54 with the pump rotor 34.

The pump rotor 34 is surrounded by a pump outlet volute 26 which is defined by a fluid housing part 20 defined by a plastic fluid housing part body 20' which also defines an axial pump inlet duct 28 and a tangential pump outlet duct (not shown in the drawings).

The dry motor stator 50 comprises a plurality of identical ferromagnetic transversal stator metal sheets 51 and the stator coils 52 which define several electromagnetic stator poles.

The pump motor 14 comprises a pot-like motor housing frame 80 which is made of a deep-drawn metal sheet body 80' of a ferromagnetic metal. The motor housing frame 80 defines a substantially cylindrical frame side wall 84 and a transversal frame bottom wall 82. The frame bottom wall 82 has two portions, i.e., a central bottom wall portion defining the transversal separation wall 64 for fluidically separating the wet motor rotor chamber 62 from the dry electronics chamber 40, and a ringlike ring bottom wall portion 63 radially surrounding the transversal separation wall 64. The motor housing frame 80 also defines a cylindrical axial support collar 66 protruding proximally axially from the transversal plane XZ of the frame bottom wall 82. The inside surface of the cylindrical axial support collar 66 directly supports a radial outside surface 702' of a substantially cylindrical support section 702 of the separation tube 70. The frame bottom wall 82 defines the complete proximal transversal wall 90 of the electronics chamber 40 separating the electronics chamber 40 from the wet motor rotor chamber 62 and the motor stator chamber 61.

Figure 2:
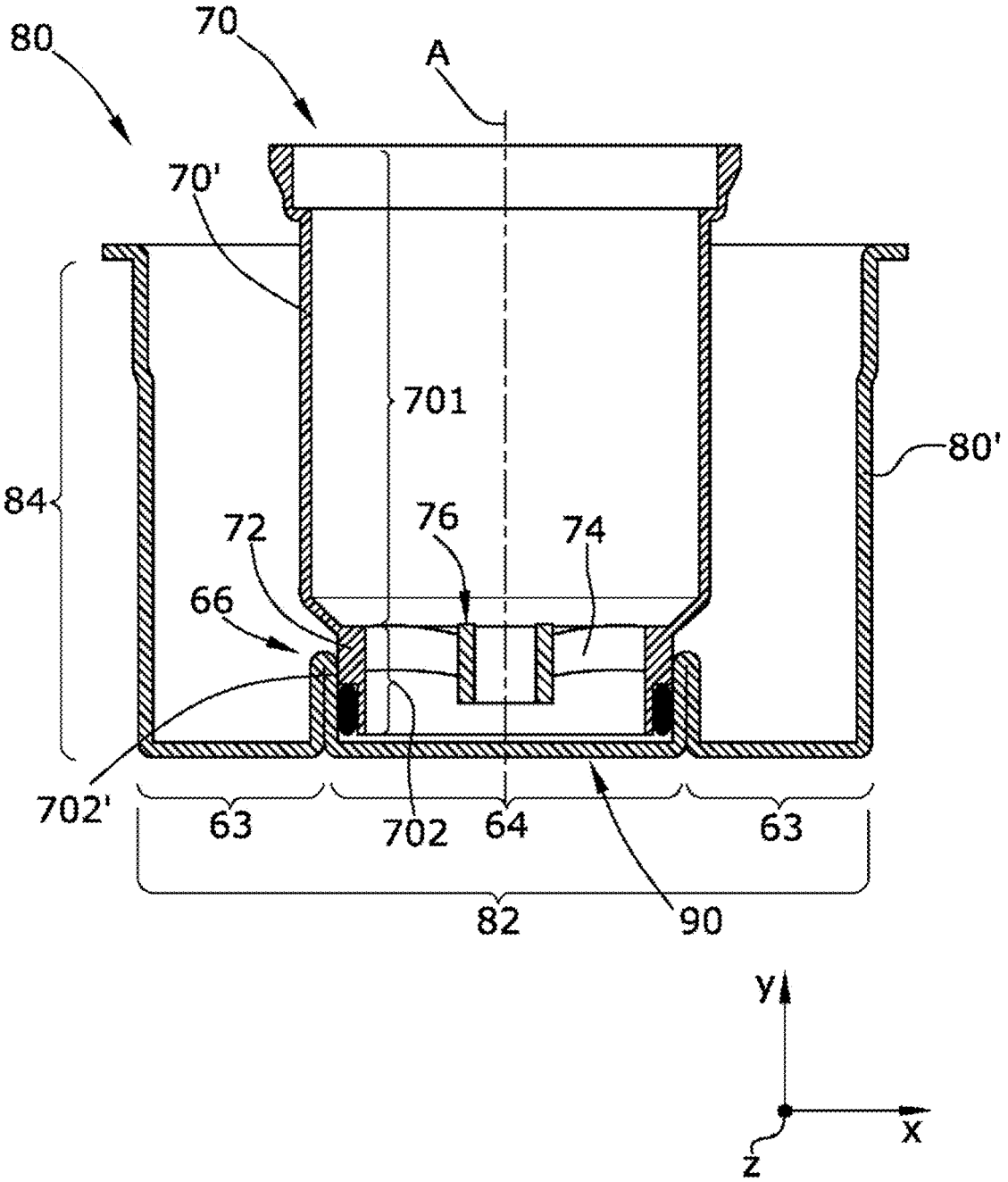
FIG. 2 shows only the motor housing frame and the separation tube of FIG. 1 in a longitudinal section.

The separation tube 70 is made of a plastic separation tube body 70' and has a substantially cylindrical airgap section 701 and the support section 702 with an enforced support ring 72. The support section 702 is substantially defined by the support ring 72 and has a reduced radius compared to the airgap section 701, as shown in FIG. 2. The separation tube 70 also defines a ring-like rotor shaft bearing support 76 which rotatably supports the rotor shaft 30. The rotor shaft bearing support 76 is held by several radial support arms 74. The separation tube 70 is one integral part.

The pump housing is defined by the fluid housing part 20, a separate motor housing 22 which completely houses the motor housing frame 80, and an electronics chamber lid 24.

The motor housing 22 is defined by a plastic motor housing body 22', and the electronics chamber lid 24 is defined by a plastic lid body 24'.

The present invention is not limited to embodiments described herein; reference should be had to the appended claims.

LIST OF REFERENCE CHARACTERS

10 Automotive electronic fluid pump
14 Brushless electric pump motor
20 Fluid housing part
20 Fluid housing part body
22 Motor housing
22' Motor housing body
24 Electronics chamber lid
24' Lid body
26 Pump outlet volute
28 Pump inlet duct
30 Rotor shaft
31 Coolant channel bore
34 Pump rotor
35 Pump rotor inlet opening
36 Pump rotor outlet opening
40 Electronics chamber
42 Motor electronics
44 Power semiconductors
50 Dry motor stator
51 Stator metal sheets
52 Stator coils
54 Wet motor rotor
55 Rotor sheets
56 Rotor pole magnets
61 Dry motor stator chamber
62 Wet motor rotor chamber
63 Bottom wall portion
64 Transversal separation wall
66 Cylindrical axial support collar
70 Separation tube
70 Separation tube body
72 Support ring
74 Support arm
76 Rotor shaft bearing support
80 Motor housing frame
80' Metal sheet body
82 Frame bottom wall
84 Frame side wall
90 Transversal wall
701 Airgap section
702 Support section
702' Outside surface
A Longitudinal pump axis

What is claimed is:

1. An automotive electronic fluid pump comprising an electric pump motor, the electric pump motor comprising:

an electromagnetic motor stator comprising stator coils;

a rotor comprising a motor rotor, a pump rotor, and a rotor shaft, the motor rotor being configured to be electromagnetically driven by the electromagnetic motor stator;

a motor electronics which is arranged within a dry electronics chamber, the motor electronics comprising a commutation electronics and power semiconductors, the power semiconductors being configured to energize the stator coils;

a separation tube which fluidically separates a wet motor rotor chamber from a dry motor stator chamber, the separation tube comprising a support section; and a motor housing frame which is arranged to be pot-like, the motor housing frame being an integral, single component formed from a deep-drawn metal sheet body, the motor housing frame comprising a support collar, a frame bottom wall, and a frame side wall which is arranged to be substantially cylindrical, a first inside layer of the support collar being configured to directly support the support section of the separation tube;

wherein, the frame bottom wall defines a substantially transversal separation wall which fluidically separates the wet motor rotor chamber from the dry electronics chamber, the frame side wall supports a radial outside of the electromagnetic motor stator, and the support collar of the motor housing frame is made via a reverse-drawing of the deep-drawn metal sheet body.

2. The automotive electronic fluid pump as recited in claim 1, wherein, the support section of the separation tube comprises a radial outside surface, and the support collar of the motor housing frame is further configured to support the radial outside surface of the support section of the separate separation tube.

3. The automotive electronic fluid pump as recited in claim 1, wherein the separation tube comprises a plastic separation tube body.

4. The automotive electronic fluid pump as recited in claim 1, wherein, the support section of the separation tube has a radius, the separation tube further comprises an airgap section, the airgap section has a radius, and the radius of the airgap section is larger than the radius of the support section.

5. The automotive electronic fluid pump as recited in claim 1, wherein the separation tube further comprises a rotor shaft bearing support which is configured to rotatably support the rotor shaft.

6. The automotive electronic fluid pump as recited in claim 1, wherein, the dry electronics chamber comprises a proximal transversal wall, and the proximal transversal wall is entirely defined by the frame bottom wall of the motor housing frame.

7. The automotive electronic fluid pump as recited in claim 1, further comprising:

a separate plastic motor housing which is configured to house the motor housing frame.

8. The automotive electronic fluid pump as recited in claim 1, wherein the electronic fluid pump is a liquid pump.

9. The automotive electronic fluid pump as recited in claim 1, wherein the electronic fluid pump is a coolant liquid pump.

* * * * *